US007864156B2

(12) United States Patent
Okita et al.

(10) Patent No.: US 7,864,156 B2
(45) Date of Patent: Jan. 4, 2011

(54) LIQUID CRYSTAL DISPLAY DEVICE, LIGHT SOURCE DEVICE, AND LIGHT SOURCE CONTROL METHOD

(75) Inventors: Mitsutaka Okita, Hakusan (JP); Kazuhiro Nishiyama, Kanazawa (JP); Shigesumi Araki, Ishikawa-gun (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 762 days.

(21) Appl. No.: 11/754,734

(22) Filed: May 29, 2007

(65) Prior Publication Data

US 2007/0273678 A1 Nov. 29, 2007

(30) Foreign Application Priority Data

May 29, 2006 (JP) ..... 2006-148181
May 25, 2007 (JP) ..... 2007-139581

(51) Int. Cl.
*G09G 3/36* (2006.01)

(52) U.S. Cl. ..... 345/102; 345/204; 345/89; 345/690

(58) Field of Classification Search ..... 345/87, 345/89, 102, 204, 690, 691; 349/143; 348/739
See application file for complete search history.

(56) References Cited

U.S. PATENT DOCUMENTS 7,218,333 B2 * 5/2007 Choi ..... 345/691
7,465,104 B2 * 12/2008 Tokui et al. ..... 385/65
7,595,784 B2 * 9/2009 Yamamoto et al. ..... 345/102
2007/0091056 A1 4/2007 Okita et al.
2007/0120809 A1 5/2007 Araki et al.

FOREIGN PATENT DOCUMENTS

JP 2006-134780 5/2006

* cited by examiner

*Primary Examiner*—Abbas I Abdulselam
(74) *Attorney, Agent, or Firm*—Oblon, Spivak, McClelland, Maier & Neustadt, L.L.P.

(57) ABSTRACT

A liquid crystal display device includes a liquid crystal display panel which periodically performs graduation display and non-graduation display, a backlight which illuminates the liquid crystal display panel, and a light source control circuit which sets an illumination period that allows illumination of the backlight for the gradation display and drives the backlight unit during the illumination period. The light source control circuit is configured to drive the backlight intermittently during the illumination period in limiting the luminance of the backlight.

9 Claims, 8 Drawing Sheets

LIQUID CRYSTAL DISPLAY DEVICE, LIGHT SOURCE DEVICE, AND LIGHT SOURCE CONTROL METHOD

CROSS-REFERENCE TO RELATED APPLICATIONS

This application is based upon and claims the benefit of priority from the prior Japanese Patent Application No. 2006-148181, filed May 29, 2006, and Japanese Patent Application No. 2007-139581, filed May 25, 2007, the entire contents of which are incorporated herein by reference.

BACKGROUND OF THE INVENTION

1. Field of the Invention

The present invention relates to a liquid crystal display device, a light source device, and a light source control method that blinks illumination light on and off for gradation display and non-gradation display which are performed periodically.

2. Description of the Related Art

In recent years, a liquid crystal display panel of the OCB mode has received attention because it has a good response of liquid crystal molecules required for display of moving images. With this liquid crystal display panel, the liquid crystal molecules are in a splay alignment before supply of power. This splay alignment is a state where the liquid crystal molecules are virtually laid down, and is transitioned to a bend alignment for display operation, upon supply of power. The splay alignment is more stable than the bend alignment in terms of energy. The reverse transition to the splay alignment tends to occur if a voltage-non-applied state, or a voltage applied state of a voltage not greater than a level at which energy of the splay alignment is balanced with energy of the bend alignment, continues for a long time. Conventionally, as a measure for preventing the reverse transition, a driving method has been proposed which periodically applies a large voltage to all liquid crystal pixels (see, for example, Japanese Patent Applications Nos. 2000-214827 and 2002-107695). With a normally white liquid crystal display panel, since the above-mentioned voltage corresponds to a pixel voltage that provides black display, the driving method is referred to as black insertion driving.

The liquid crystal display panel is a hold type display device that causes all pixels to hold pixel voltages for each frame period, which is the display image updating cycle. With the black insertion driving, for example, pixel voltages for gradation display are applied to all the pixels in units of one row in the first half of one frame period (one vertical scanning period) and pixel voltages for black insertion are applied to all the pixels in units of one row in the second half of the same frame period. Each pixel holds a pixel voltage for gradation display until application of a pixel voltage for black insertion, and then holds the pixel voltage for black insertion until application of a pixel voltage for gradation display. Here, the ratio of the holding period of pixel voltage for black insertion to the holding period of pixel voltage for gradation display is referred to as the black insertion ratio.

With the hold type display device, it is difficult to display the movement of an object smoothly due to retinal persistence occurring on viewer's vision in a moving image display. The black insertion driving causes the retinal persistence to be cleared by discrete pseudo-impulse response of luminance, and is therefore effective in improving the visibility of moving images that lowers according to the viewer's vision. However, the black display state obtained by the black insertion driving does not provide perfect black as obtained when the backlight, which is an illumination light source, is turned off. For this reason, to obtain better visibility of moving images the employment of blinking driving to blink the backlight on and off has been studied. Incidentally, the black insertion ratio required to prevent the reverse transition is of the order of 2.5%. The visibility of moving images improves as the black insertion ratio increases.

With use of blinking driving, the ratio of the backlight lighting period to the blinking cycle, which is normally one vertical scanning period, is usable to adjust the brightness of the entire liquid crystal display panel. Conventionally, the backlight lighting period is controlled by the pulse duration (pulse width) of a pulse width modulation (PWM) signal, and lighting control to limit the luminance of the backlight is performed by reducing the pulse duration. However, the difference in optical response between the liquid crystal pixels and the backlight results in a problem that the contrast ratio considerably drops as the pulse duration decreases.

BRIEF SUMMARY OF THE INVENTION

It is an object of the present invention to provide a liquid crystal display device, a light source device, and a light source control method which permit the prevention of lowering of the contrast ratio caused by lighting control in blinking driving.

According to a first aspect of the invention, there is provided a liquid crystal display device comprising; a display panel which periodically performs graduation display and non-graduation display; a light source unit which illuminates the display panel; and a light source control circuit which sets an illumination period that allows illumination of the light source unit for the gradation display and drives the light source unit during the illumination period, the light source control circuit being configured to drive the light source unit intermittently during the illumination period in limiting the luminance of the light source unit.

According to a second aspect of the invention, there is provided a light source device comprising: a light source unit which illuminates a display panel adapted to periodically perform gradation display and non-gradation display; and a light source control circuit which sets an illumination period that allows illumination of the light source unit for the gradation display, the light source control circuit being configured to drive the light source intermittently during the illumination period in limiting the luminance of the light source unit.

According to a third aspect of the invention, there is provided a light source control method for a light source which illuminates a display panel that periodically perform gradation display and non-gradation display, comprising the steps of: setting an illumination period that allows illumination of the light source unit for the gradation display; driving the light source unit during the illumination period; and driving the light source unit intermittently during the illumination period in limiting the luminance of the light source unit.

With the liquid crystal display device, the light source device, and the light source control method thus configured, an illumination period that allows illumination of the light source unit for the gradation display is set and driving of the light source unit is carried out during that illumination period. In limiting the luminance of the light source unit, the light source unit is driven intermittently during the illumination period. With the driving manner, the illumination period is not varied by limiting the luminance of the light source unit, thus permitting the prevention of lowering of the contrast ratio.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
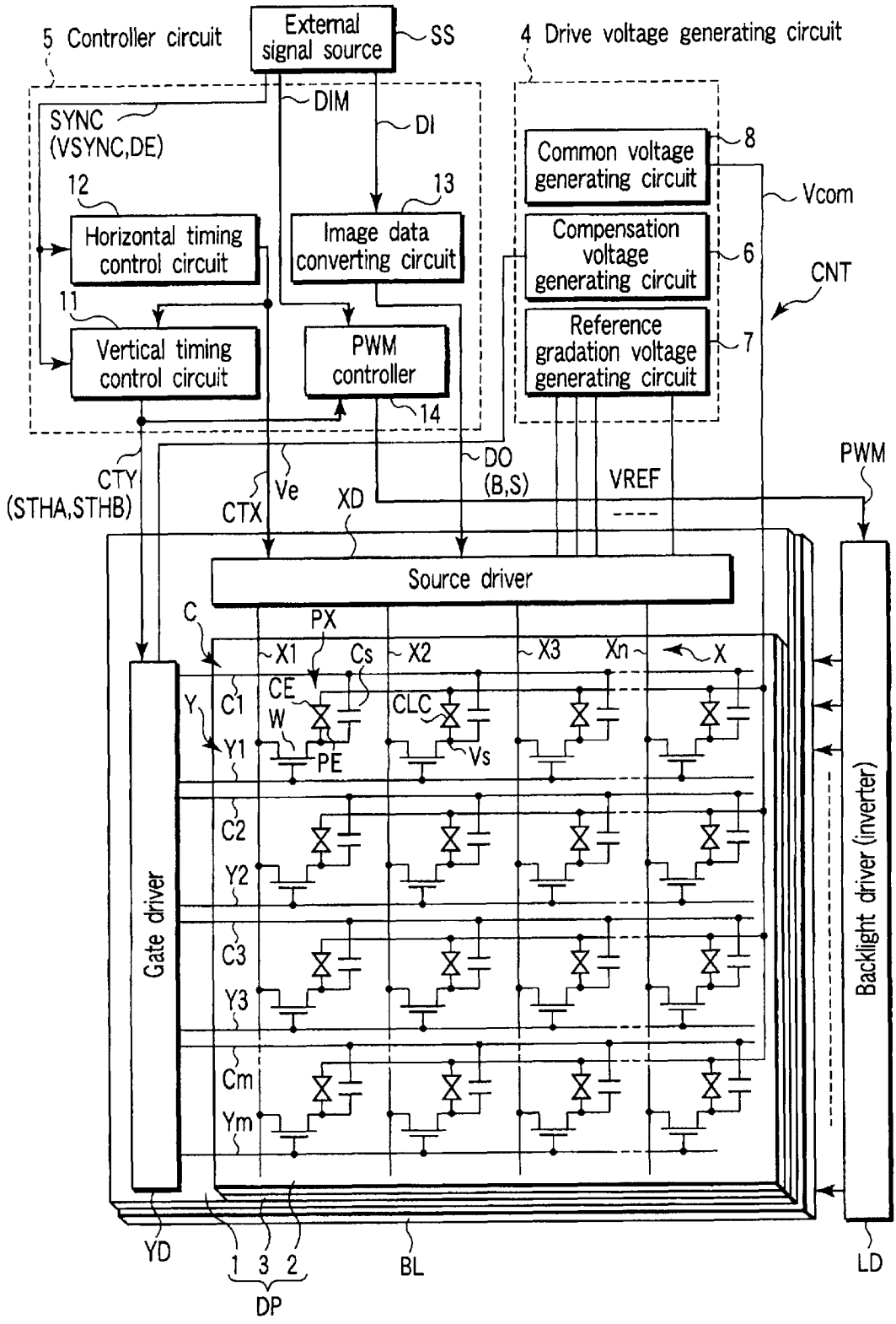
FIG. 1 is a diagram schematically showing the circuit configuration of a liquid crystal display device according to an embodiment of the invention.

A liquid crystal display device according to an embodiment of the present invention will be described hereinafter with reference to the accompanying drawings. FIG. 1 schematically shows the circuit configuration of the liquid crystal display device. The liquid crystal display device includes a liquid crystal display panel DP which periodically performs a gradation display and a non-gradation display, a backlight BL which illuminates the display panel DP, and a display control circuit CNT which controls the display panel DP and the backlight BL.

The liquid crystal display panel DP has a structure in which a liquid crystal layer 3 is held between an array substrate 1 and a counter-substrate 2 which form a pair of electrode substrates. The liquid crystal layer 3 contains a liquid crystal material in which liquid crystal molecules are transitioned in advance from a splay alignment to a bend alignment that enables display operation. The display control circuit CNT performs an initialization process to transition the liquid crystal molecules from the splay alignment to the bend alignment by a relatively strong electric field upon supply of power. After the initialization process, the liquid crystal display panel DP becomes into a state capable of having transmittance corresponding to a liquid crystal drive voltage applied to the liquid crystal layer 3 from the array substrate 1 and the counter-substrate 2. The display control circuit CNT controls the liquid crystal display panel DP such that the non-gradation display is performed at a desired ratio to the gradation display. The gradation display is made through the use of a liquid crystal drive voltage that varies according to image information. The non-gradation display is made using a constant liquid crystal drive voltage. Here, the constant liquid crystal drive voltage is a voltage to prevent reverse transition from the bend alignment to the splay alignment. With the liquid crystal display panel DP in the normally white mode, display of black is effected when the voltage to prevent reverse transition is applied to the liquid crystal layer 3 as the constant liquid crystal drive voltage. That is, the black insertion is performed periodically with respect to the gradation display. In the description which follows, the black insertion is used as an example of non-gradation display.

The array substrate 1 has a plurality of pixel electrodes PE arranged in a matrix on a transparent insulating substrate made of, for instance, glass, a plurality of gate lines Y (Y1 to Ym) arranged along the rows of pixel electrodes PE, a plurality of source lines X (X1 to Xn) arranged along the columns of pixel electrodes PE, and a plurality of pixel switching elements W which are disposed near intersections between the gate lines Y and the source lines X. Each pixel switching element W is rendered conductive between a corresponding source line X and a corresponding pixel electrode PE when it is driven through a corresponding gate line Y. Each pixel switching element W is formed of, for example, a thin-film transistor, which has a gate connected to the corresponding gate line Y and a source-to-drain path connected between the corresponding source line X and the corresponding pixel electrode PE.

The counter-substrate 2 includes a color filter having colored layers of red, green and blue arranged on a transparent insulating substrate made of, for instance, glass and a common electrode CE placed on the color filter to face the pixel electrodes PE. The pixel electrodes PE and the common electrode CE are made of a transparent electrode material, such as ITO, and are covered with alignment films which are rubbing processed in parallel with each other. The pixel electrode PE and the common electrode CE form an OCB liquid crystal pixel PX together with a pixel area which is a portion of the liquid crystal layer 3 and contains liquid crystal molecules whose tilt angles are controlled by an electric field applied from the pixel electrode PE and the common electrode CE.

Each of the liquid crystal pixels PX has a liquid crystal capacitance CLC between its pixel electrode PE and the common electrode CE. Storage capacitance lines C1 to Cm are each capacitively coupled to the pixel electrodes PE of a corresponding row of liquid crystal pixels PX to form storage capacitances Cs.

The display control circuit CNT includes a gate driver YD which sequentially drives the gate lines Y1 to Ym to turn on the switching elements W in units of one row, a source driver XD which outputs pixel voltages Vs to the source lines X1 to Xn while the switching elements W of each row are kept conductive by being driven through a corresponding gate line Y, a backlight driver LD which drives the backlight BL, a drive voltage generating circuit 4 which generates drive voltages for the display panel DP, and a controller circuit 5 which controls the gate driver YD, the source driver XD, and the backlight driver LD.

The drive voltage generating circuit 4 includes a compensation voltage generating circuit 6, a reference gradation voltage generating circuit 7, and a common voltage generating circuit 8. The compensation voltage generating circuit 6 generates a compensation voltage Ve that is applied to the storage capacitance lines C via the gate driver YD. The reference gradation voltage generating circuit 7 generates a predetermined number of reference gradation voltages VREF used by the source driver XD. The common voltage generating circuit 8 generates a common voltage Vcom that is applied to the counter-electrode CT. The controller circuit 5 includes a vertical timing control circuit 11, a horizontal timing control circuit 12, an image data converting circuit 13, and a PWM controller 14. The vertical timing control circuit 11 generates a control signal CTY for the gate driver YD on the basis of a synchronizing signal SYNC (VSYNC, DE) input from an external signal source SS. The horizontal timing control circuit 12 generates a control signal CTX for the source driver XD on the basis of the synchronizing signal SYNC (VSYNC, DE) input from the external signal source SS. The image data converting circuit 13 performs, for example, black insertion double-speed conversion on image data input from the external signal source SS for the pixels PX. The PWM controller 14 controls the backlight driver (inverters) LD on the basis of the control signal CTY output from the vertical timing control circuit 11. The image data includes items of pixel data DI for the liquid crystal pixels PX and is updated for each frame period (vertical scanning period V). The control signal CTY is applied to the gate driver YD. The control signal CTX is applied to the source driver XD together with items of pixel data DO output from the image data converting circuit 13 as a conversion result. The control signal CTY is used to allow the gate driver YD to sequentially drive the gate lines Y. The control signal CTX is used to allocate image data items DO which are serially output from the image data converting circuit 13 for each row of liquid crystal pixels PX to the source lines X and specify their respective output polarities.

The gate driver YD and the source driver XD are formed using, for example, a shift register circuit that selects each of the gate lines Y or the source lines X. In this case, the control signal CTY includes a first start signal (gradation display start signal) STHA to control the time of starting gradation display, a second start signal (black insertion start signal) STHB to control the time of starting black insertion, a clock signal to shift the first and second start signals STHA and STHB in the shift register circuits, and an output enable signal to control outputting of drive signals to the gate lines Y1 to Ym which are selected sequentially or concurrently in units of a predetermined number by the shift register circuit according to the positions where the start signal STHA or STHB is held. On the other hand, the control signal CTX includes a start signal to control the time of starting capture of pixel data for one row, a clock signal to shift that start signal in the shift register circuit, a load signal to control the timing of parallel outputting of pixel data items DO for one row which are captured for the source lines X1 to Xn which are selected in a one-by-one manner by the shift register circuit according to the position where the start signal is held, and a polarity signal to control the signal polarity of pixel voltages Vs corresponding to the pixel data.

The gate driver YD, under the control of the control signal CTY, sequentially selects the gate lines Y1 to Ym for gradation display and black insertion in one frame period, and supplies a selected gate line Y with an on voltage as a drive voltage that keeps the pixel switching elements W, connected to the selected gate line, conductive for one horizontal scanning period H. When the image data converting circuit 13 performs black insertion double-speed conversion, input pixel data DI for one row are converted for each horizontal scanning period (1H) into black insertion pixel data B for one row and gradation display pixel data S for one row, as the output pixel data DO for one row. The gradation display pixel data S have the same gradation values as the pixel data DI. The black insertion pixel data B have a gradation value for black display. Each of the black insertion pixel data B for one row and the gradation display pixel data S for one row is serially output from the image data converting circuit 13 in an H/2 period. The source driver XD refers to the predetermined number of reference gradation voltages VREF supplied from the reference gradation voltage generating circuit 7 to convert the items of pixel data B and S into pixel voltages Vs and then outputs them to the source lines X1 to Xn in parallel.

The pixel voltages Vs are ones applied to the pixel electrodes PE with the common voltage Vcom of the common electrode CE used as a reference. The difference between each pixel voltage Vs and the common voltage Vcom forms a liquid crystal drive voltage for one pixel PX. The pixel voltages Vs have their polarity inverted with respect to the common voltage Vcom so as to perform frame inversion driving and line inversion driving, for example. For black insertion driving at the double vertical scanning speed, the polarity is inverted with respect to the common voltage Vcom so as to perform line inversion driving and frame inversion driving (1H1V inversion driving), for example. The compensation voltage Vs, when the switching elements W for one row are rendered nonconductive, is applied through the gate driver YD to the storage capacitance line C corresponding to the gate line Y connected to those switching elements W, thereby compensating for variations that occur in the pixel voltages Vs of the pixels PX for one row due to parasitic capacitances of the switching elements W.

When the gate driver YD drives, for instance, the gate line Y1 with the on voltage to render conductive all the pixel switching elements W connected to that gate line, the pixel voltages Vs on the source lines X1 to Xn are applied through these pixel switching elements to the corresponding pixel elements PE and one ends of the storage capacitances Cs. In addition, the gate driver YD outputs the compensation voltage Ve from the compensation voltage generating circuit 6 onto the storage capacitance line C1 corresponding to the gate line Y1 and outputs onto the gate line Y1 an off voltage that turns off the pixel switching elements W immediately after all the switching elements W connected to the gate line Y1 were kept conductive for one horizontal scanning period. When the pixel switching elements W are made nonconductive, the compensation voltage Ve reduces charges pulled out of the pixel electrodes PE by the parasitic capacitances of the switching elements to thereby virtually cancel variations in the pixel voltages Vs, that is, the field-through voltages ΔVp.

Figure 2:
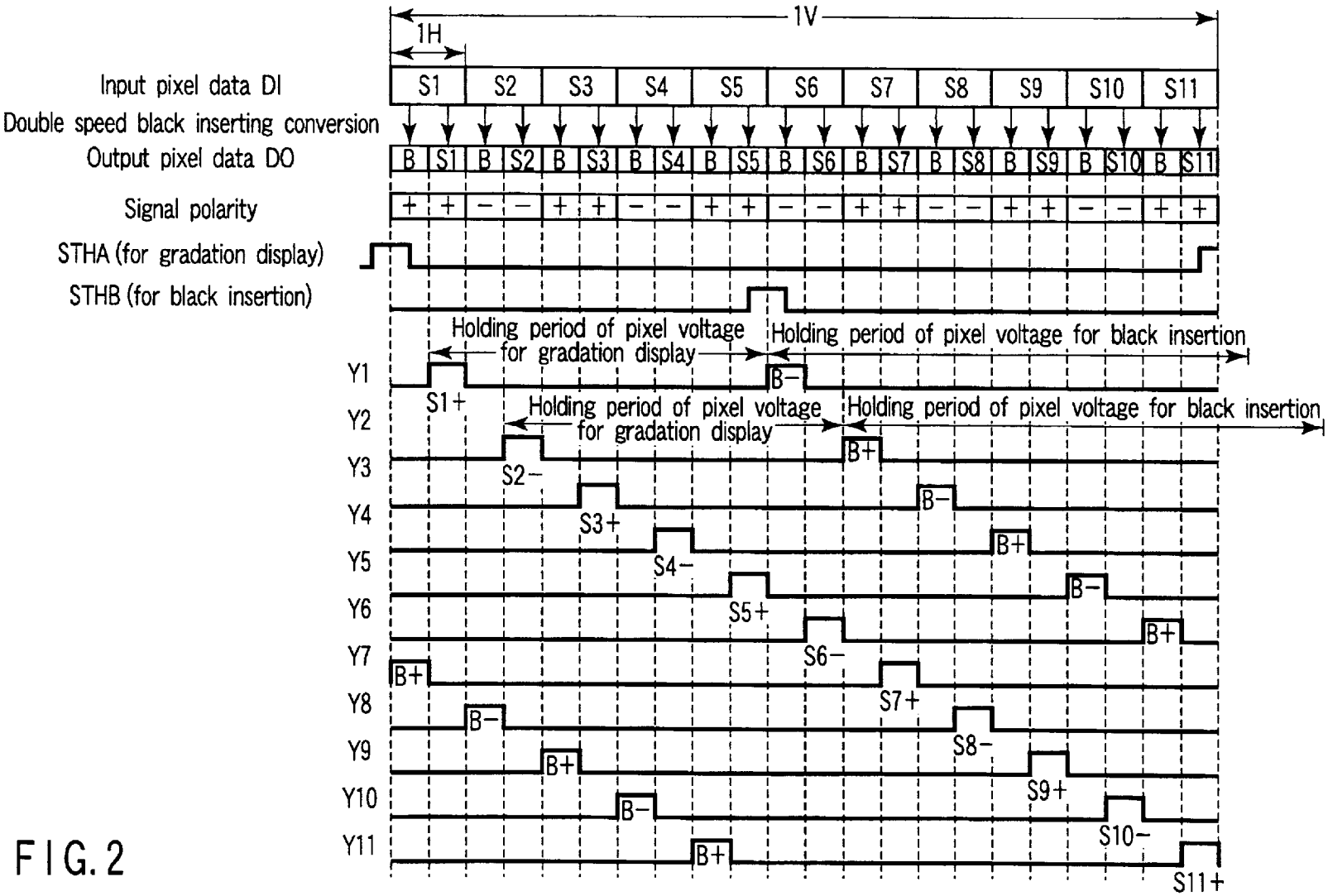
FIG. 2 is a timing chart illustrating the operation of the liquid crystal display device shown in FIG. 1 when black insertion driving is performed at the double vertical scanning speed.

FIG. 2 shows the operation of the liquid crystal display device in the case of black insertion driving at the double vertical scanning speed. In FIG. 2, B represents pixel data for black insertion common to the pixels PX in each row and S1, S2, S3, . . . represent pixel data for gradation display for the pixels PX in the first row, the second row, the third row, . . . , respectively. The symbols + and − represent signal polarities presented when pixel data B, S1, S2, S3, . . . are converted into pixel voltages Vs and output from the source driver XD.

With black insertion, the pixel voltages for black insertion and pixel voltages for gradation display are applied to all the pixels PX in units of one row for each frame period (each vertical scanning period). Here, each pixel PX holds a pixel voltage for gradation display until application of a pixel voltage for black insertion and holds the pixel voltage for black insertion until application of a pixel voltage for gradation display.

In FIG. 2, the first and second start signals STHA and STHB are each a pulse which has a pulse width corresponding to the H/2 period and is input to the gate driver YD. The first start signal STHA is first input and the second start signal STHB is input later than the first start signal in accordance with the ratio of the holding period of pixel voltage for black insertion to the holding period of pixel voltage for gradation display, i.e., the black insertion ratio.

The gate driver YD shifts the first start signal STHA to sequentially select the gate lines Y1 to Ym one per horizontal scanning period H and outputs a drive signal to the selected gate line Y1, Y2, Y3, . . . in the second half of the horizontal scanning period. In contrast, the source driver XD converts each of pixel data for gradation display S1, S2, S3, . . . into pixel voltages Vs in the second half of a corresponding horizontal scanning period and parallel outputs the pixel voltages to the source lines X1 to Xn with their polarity inverted for each horizontal scanning period (1H). The pixel voltages Vs are applied to the liquid crystal pixels PX in the first, second, third, fourth rows, . . . while the gate lines Y1 to Ym are each driven in the second halves of the respective horizontal scanning periods.

Also, the gate driver YD shifts the second start signal STHB to sequentially select the gate lines Y1 to Ym one per horizontal scanning period H and outputs a drive signal to the selected gate line Y1, Y2, Y3, . . . in the first half of the horizontal scanning period. In contrast, the source driver XD converts each of pixel data for black insertion B, B, B, . . . into pixel voltage Vs in the first half of the corresponding horizontal scanning periods and parallel outputs the pixel voltages to the source lines X1 to Xn with their polarity inverted for each horizontal scanning period (1H). The pixel voltages Vs are applied to the liquid crystal pixels PX in the first, second, third, fourth rows, . . . while the gate lines Y1 to Ym are each driven in the first halves of the respective horizontal scanning periods. In FIG. 2, the first start signal STHA and the second start signal STHB are input at a relatively short interval of time; however, in practice they are input spaced in time so that the ratio of the holding period of pixel voltage for black insertion to the holding period of pixel voltage for gradation display conforms to the black insertion ratio. The black insertion for pixels PX in the vicinity of the last row will continue from the preceding frame as shown in the lower left-hand portion of FIG. 2.

Figure 3:
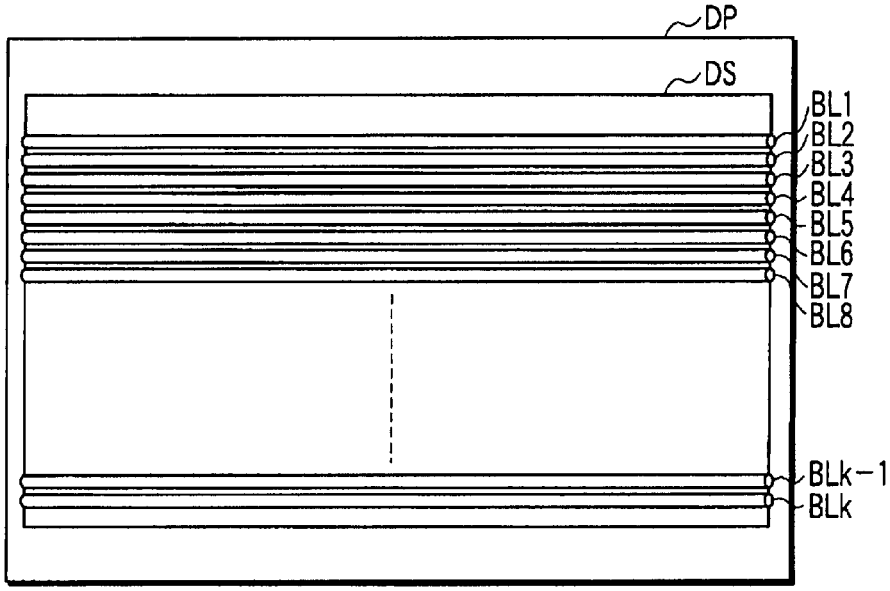
FIG. 3 is a diagram showing a relationship between the backlight and the display panel shown in FIG. 1.

FIG. 3 shows a relationship between the backlight BL and the display panel DP shown in FIG. 1. A display screen shown in FIG. 3 is composed of OCB liquid crystal pixels PX arranged in a matrix. The backlight BL is comprised of, for instance, k number of backlight sources BL1 to BLk that are arranged at a predetermined pitch in parallel with the rows of OCB liquid crystal pixels PX at the back of the display panel DP. The backlight sources BL1 to BLk mainly illuminate respective display areas which have been obtained by equally dividing the screen DS in the vertical direction. Here, each of the backlight sources BL1 to BLk is comprised of a cold cathode tube and illuminates one display area consisting of about 30 rows of liquid crystal pixels PX.

Figure 4:
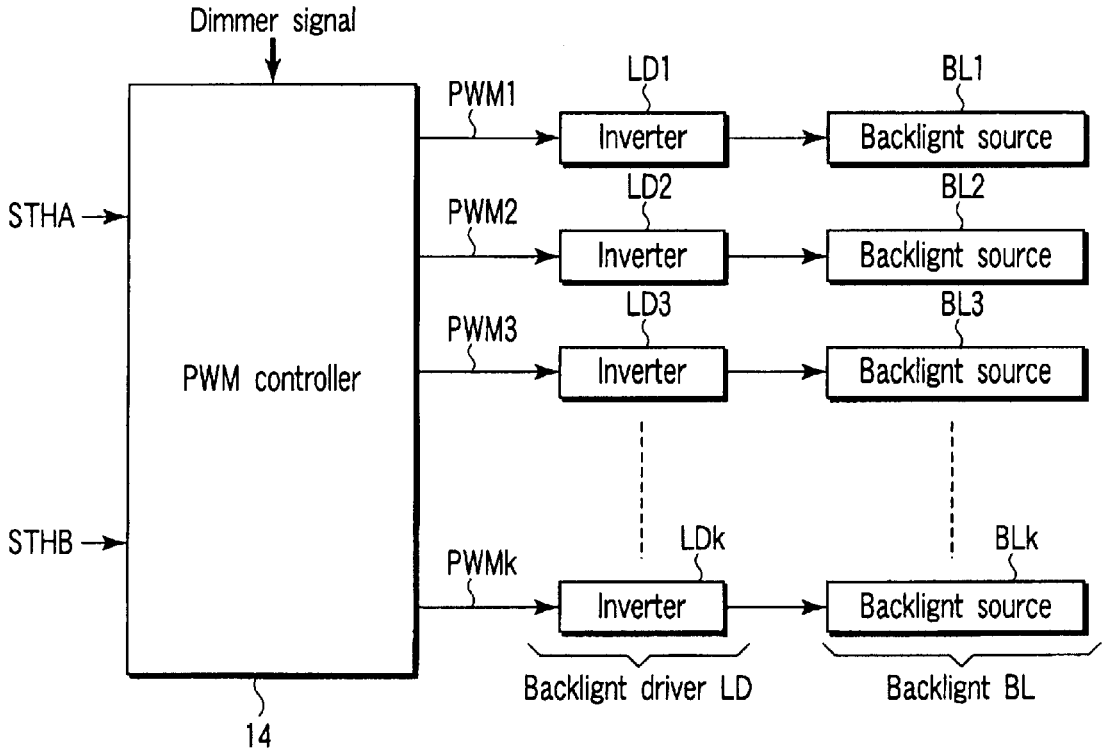
FIG. 4 is a detailed block diagram of a PWM controller, a backlight driver, and a backlight which are shown in FIG. 1.

FIG. 4 shows the detailed circuit configuration of the PWM controller 14, the backlight driver LD, and the backlight BL shown in FIG. 1. The external signal source SS shown in FIG. 1 supplies the PWM controller 14 a dimmer signal DIM to adjust the brightness of the liquid crystal display panel DP, that is, the luminance of the backlight BL. The PWM controller 14 and the backlight driver LD serve as a light source control circuit which sets an illumination period that allows illumination for gradation display with the backlight BL, which illuminates the liquid crystal display panel DP that periodically performs the gradation display and non-gradation display, drives the backlight BL during that illumination period, and intermittently drives the backlight BL during the illumination period in a case where the luminance of the backlight BL is to be limited. The PWM controller 14 controls the backlight driver LD so as to initiate an operation of sequentially blinking each of the backlight sources BL1 to BLk on and off in synchronization with the first start signal STHA. The backlight driver LD is equipped with k number of inverters LD1 to LDk which are adapted to generate drive voltages to the backlight sources BL1 to BLk, respectively. The PWM controller 14 generates k number of pulse width modulation signals PWM (PWM1 to PWMk) which control the inverters LD1 to LDk, respectively. The duty ratios of the pulse width modulation signals PWM1 to PWMk are set as the ratio of the illumination period to the period of gradation display and non-gradation display, i.e., the total of the gradation display period and the non-gradation display period. The inverters LD1 to LDk drive the backlight sources BL1 to BLk during the pulse duration of the pulse width modulation signals PWM1 to PWMk (total pulse width), respectively. In order to limit the luminance of the backlight BL, that is, the backlight sources BL1 to BLk, the PWM controller 14 is arranged to insert a group of pulses in each of the pulse width modulation signals PWM1 to PWMk to thin out or periodically interrupt its pulse duration. Each of the pulse width modulation signals PWM1 to PWMk will be repeatedly set to high and low levels by the inserted group of pulse duration interruption pulses.

The pulse width modulation signal PWM1 is generated using the first start signal STHA which is output as the control signal CTX from the vertical timing control circuit 11 as with the second start signal STHB. The first start signal STHA provides a reference timing to cause the liquid crystal pixels PX in the first row to hold pixel voltages for gradation display. The second start signal STHB provides a reference timing to cause the liquid crystal pixels PX in the first row to hold pixel voltages for black insertion. That is, the gradation display period (the holding period of pixel voltages for gradation display) is approximately equal to the time interval from the time the first start signal STHA is input until the second start signal STHB is input. The black insertion period (the holding period of pixel voltages for black insertion) is nearly equal to the time interval from the time the second start signal STHB is input until the first start signal STHA is input.

Figure 5:
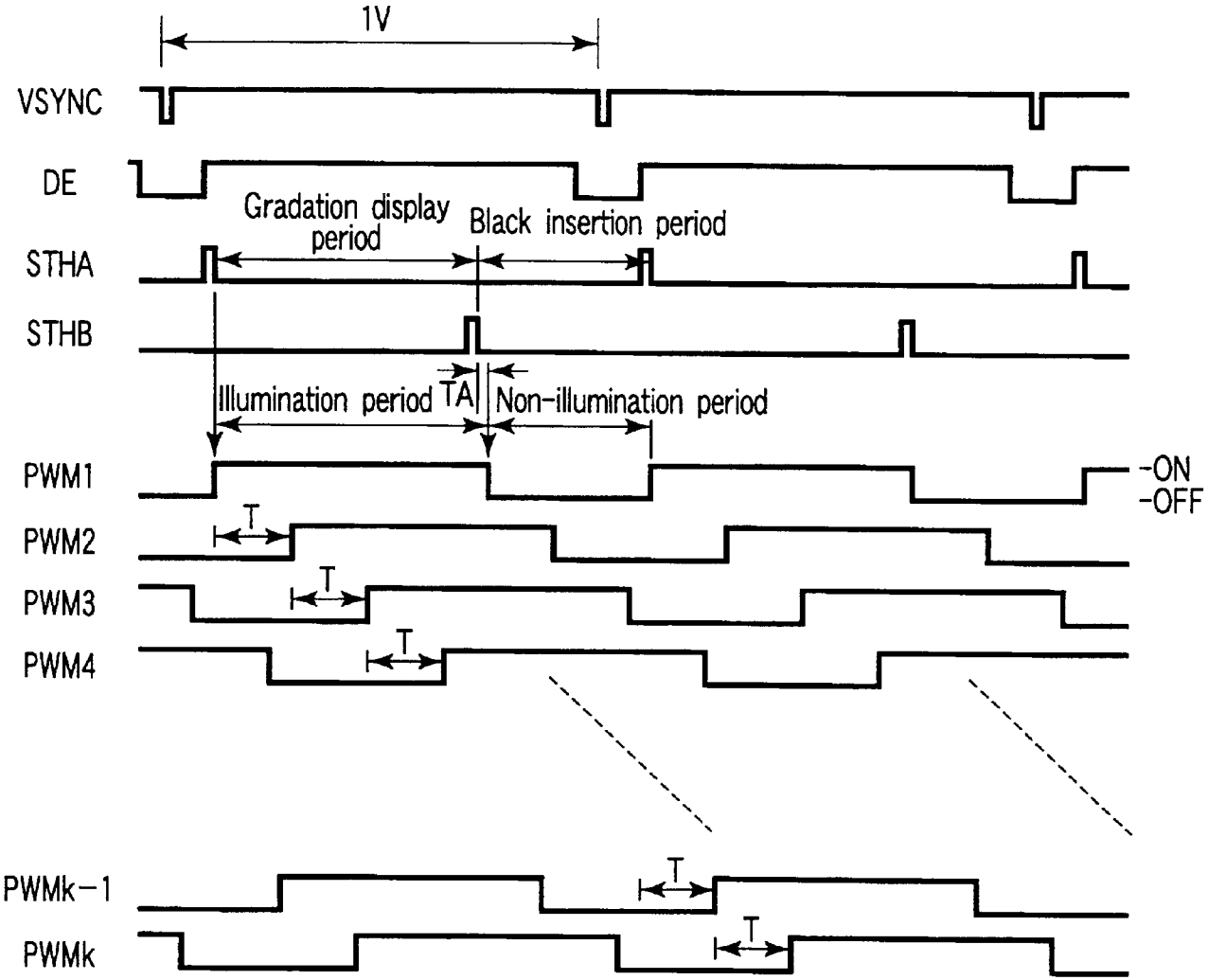
FIG. 5 is a timing chart illustrating the operation of the PWM controller shown in FIG. 1 when the luminance of the backlight is not limited.

FIG. 5 illustrates the operation of the PWM controller 14 when the luminance of the backlight is not limited. When the dimmer signal DIM does not limit the brightness of the display panel DP, that is, the luminance of the backlight BL, the pulse width modulation signals PWM1 to PWMk having waveforms as shown in FIG. 5 are applied from the PWM controller 14 to the inverters LD1 to LDk in order to set the luminance of the backlight BL to 100%.

The PWM controller 14 raises the pulse width modulation signal PWM1 to a high level upon detecting a transition of the start signal STHA (i.e., the pulse leading edge or trailing edge) and then lowers the signal PWM1 upon lapse of the illumination period from the time when it is raised. Specifically, for example, a counter is provided which counts clock pulses. This counter starts counting the clock pulses at the time when the start signal STHA makes a transition. At the time when the count in the counter reaches a predetermined value, the pulse width modulation signal PWM1 is lowered. Here, the predetermined count value is determined such that the illumination period is set longer than the gradation display period by a period of time TA corresponding to the delay of response of liquid crystal pixels PX and consequently the non-illumination period is set shorter than the black insertion period.

The duty ratio of the pulse width modulation signal PWM1 is thus set as the ratio of the illumination period to the total of the gradation display period and the non-gradation display period. The pulse width modulation signals PWM2 to PWMk, which can be obtained by delaying the pulse width modulation signal PWM1 in time, are displaced in phase by T relative to the pulse width modulation signals PWM1 to PWMk−1, respectively, as shown in FIG. 5. The phase difference T is determined in accordance with the pitch of the backlight sources BL1 to BLk. The inverters LD1 to LDk convert the pulse width modulation signals PWM1 to PWMk into drive voltages, which in turn are output to the backlight sources BL1 to BLk. Each of the backlight sources BL1 to BLk is turned on when a corresponding one of the pulse width modulation signals PWM1 to PWMk is at a high level and is turned off when it goes low.

Figure 6:
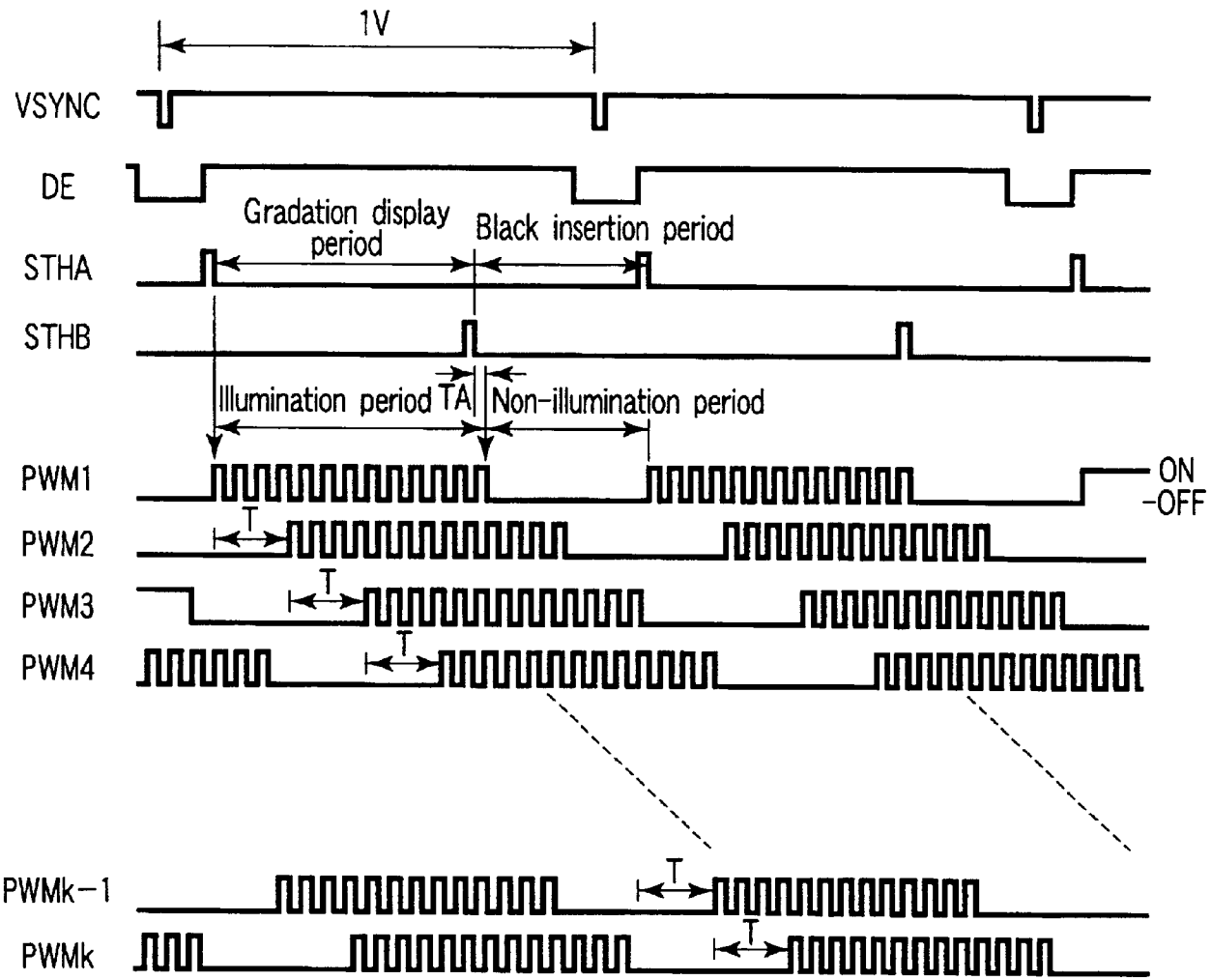
FIG. 6 is a timing chart illustrating the operation of the PWM controller shown in FIG. 1 when the luminance of the backlight is to be limited.

FIG. 6 illustrates the luminance limiting operation of the PWM controller 14. When the dimmer signal DIM limits the brightness of the display panel DP, or the luminance of the backlight BL to, for instance, 50%, the PWM controller 14 supplies the inverters LD1 to LDk with pulse width modulation signals PWM1 to PWMk with waveforms shown in FIG. 6 to set the luminance of the backlight BL to 50%.

Here, the PWM controller 14 performs the operation described with reference to FIG. 5 except that, as shown in FIG. 6, a group of pulses that makes the pulse duration discontinuous is inserted into each of the pulse width modulation signals PWM1 to PWMk to thereby limit the luminance of the backlight BL. In this case, the pulse duration of each of the pulse width modulation signals PWM1 to PWMk is reduced effectively, whereby the backlight sources BL1 to BLk are driven intermittently during the illumination period. In the PWM controller 14, the pulse width of the interruption pulses is determined to meet the dimmer signal DIM so as to limit the luminance of the backlight BL properly.

Figure 7:
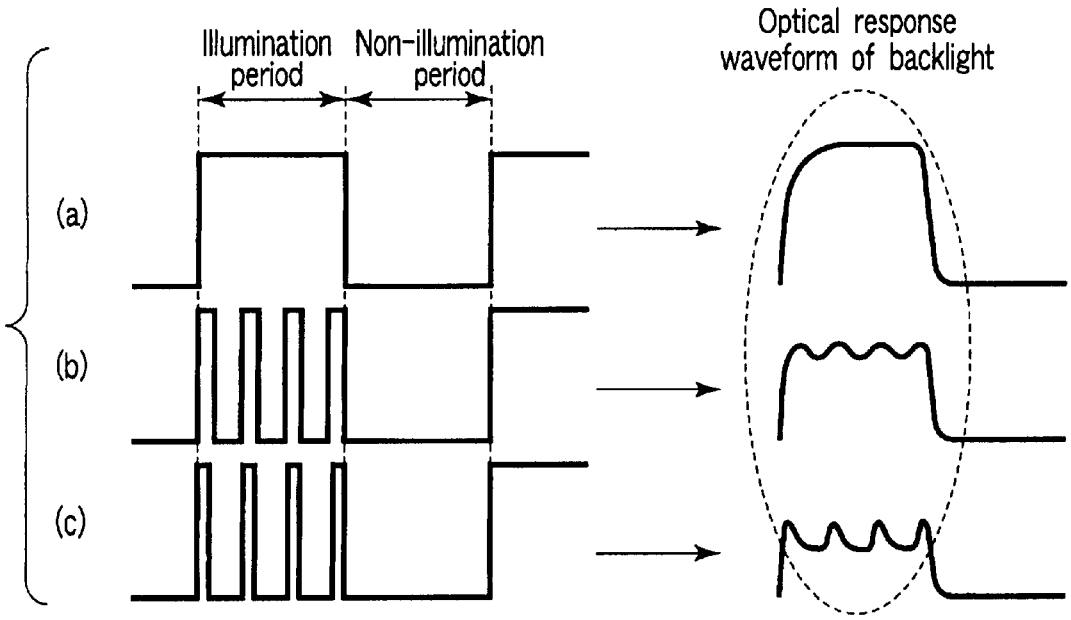
FIG. 7 is a diagram showing optical response waveforms of the backlight obtained for three types of pulse width modulation signals output from the PWM controller shown in FIG. 1.
Figure 8:
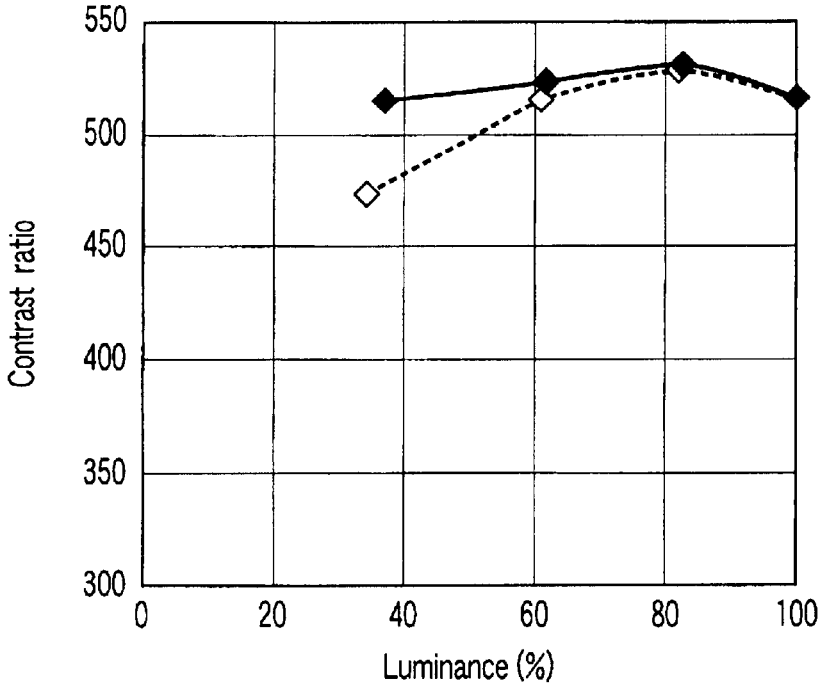
FIG. 8 is a graph illustrating changes in the contrast ratio when the luminance of the backlight shown in FIG. 1 is limited.

FIG. 7 shows optical response waveforms of the backlight BL obtained for three types of pulse width modulation signals PWM output from the PWM controller 14. When the luminance of the backlight BL is 100% as requested by the dimmer signal DIM, the PWM controller 14 outputs a pulse width modulation signal PWM during the illumination period without inserting interruption pulses. As a result, such an optical response waveform as shown in (a) of FIG. 7 is obtained for each of the backlight sources BBL1 to BLk. If the luminance of the backlight BL requested by the dimmer signal DIM is less than 100%, the PWM controller 14 puts a group of interruption pulses in the pulse width modulation signal PWM during the illumination period. As a result, such an optical response waveform as shown in (b) of FIG. 7 is obtained for each of the backlight sources BL1 to BLk. If the luminance of the backlight BL requested by the dimmer signal DIM is less than that in (b) of FIG. 7, the PWM controller 14 puts a group of interruption pulses having their pulse width increased in the pulse width modulation signal PWM during the illumination period. As a result, such an optical response waveform as shown in (c) of FIG. 7 is obtained for each of the backlight sources BL1 to BLk. In (b) and (c) of FIG. 7, the average luminance of the backlight BL is lowered by inserting a group of interruption pulses in each pulse width modulation signal PWM to thereby intermittently drive each of the backlight sources BL1 to BLk during the illumination period. However, the period from the rising edge to the falling edge of the response waveform virtually conforms to the illumination period. Therefore, even if the optical response of the liquid crystal pixels PX is delayed with respect to that of the backlight BL, the contrast ratio will not drop significantly. When contrast ratio measurements were actually made, such contrast ratios as shown by solid line in FIG. 8 were obtained for some values of the luminance of the backlight BL. That is, the contrast ratio was 515, 530, 525, and 515 when the luminance was 100%, 83%, 62%, and 37%, respectively.

Figure 9:
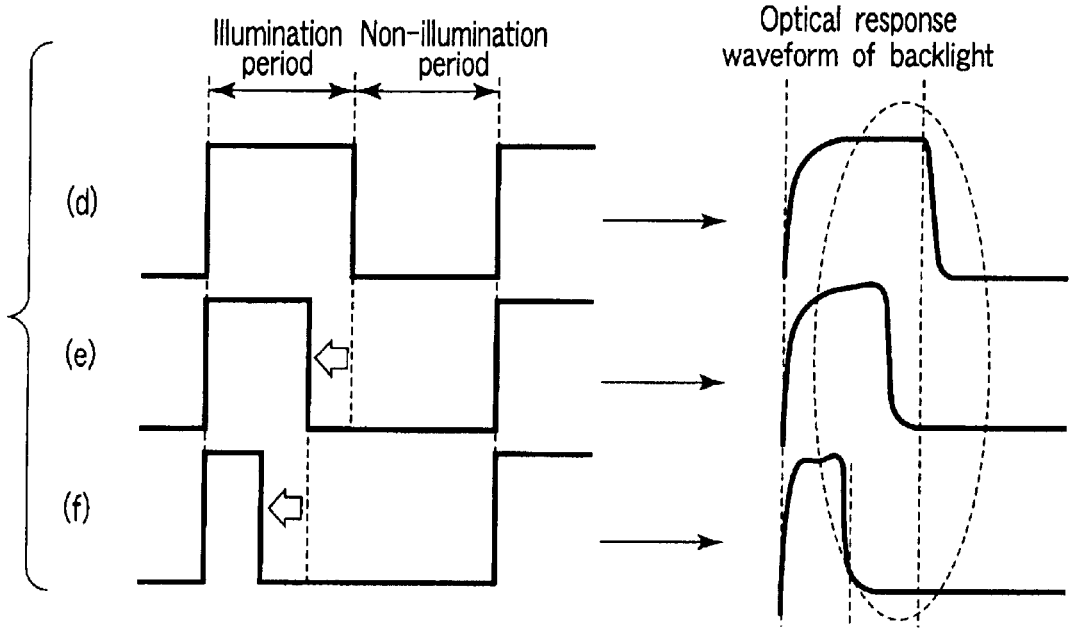
FIG. 9 shows optical response waveforms of the backlight obtained when the three types of pulse width modulation signals shown in FIG. 7 are replaced with conventional ones.

Then, an attempt was made to replace the three types of pulse width modulation signals PWM from the PWM controller 14 with conventional ones. When the luminance of the backlight BL is 100% as requested by the dimmer signal DIM, the PWM controller 14 outputs a pulse with modulation signal PWM without changing its pulse width during the illumination period. As a result, such an optical response waveform as shown in (d) of FIG. 9 is obtained for each of the backlight sources BL1 to BLk. When the luminance of the backlight BL is less than 100% as requested by the dimmer signal DIM, the PWM controller 14 outputs a pulse with modulation signal PWM which falls early during the illumination period. As a result, such an optical response waveform as shown in (e) of FIG. 9 is obtained for each of the backlight sources BL1 to BLk. When the luminance of the backlight BL is less than that in (e) of FIG. 9 as requested by the dimmer signal DIM, the PWM controller 14 outputs a pulse with modulation signal PWM which falls earlier during the illumination period. As a result, such an optical response waveform as shown in (f) of FIG. 9 is obtained for each of the backlight sources BL1 to BLk. In (e) and (f) of FIG. 9, the luminance of the backlight BL is lowered by continuously driving each of the backlight sources BL1 to BLk with the pulse width modulation signal PWM fallen early during the illumination period. With this conventional method, however, the period from the rising edge to the falling edge of the response waveform becomes shorter than the illumination period. Accordingly, the contrast ratio drops significantly due to the difference in optical response between the liquid crystal pixels PX and the backlight BL. When contrast ratio measurements were actually made, such contrast ratios as shown by broken line in FIG. 8 were obtained for some values of the luminance of the backlight BL. That is, the contrast ratio was 515, 528, 514, and 473 when the luminance was 100%, 83%, 61%, and 34%, respectively.

In this embodiment, the illumination period that allows illumination of the backlight BL for gradation display BL is set, and the backlight BL is driven during the illumination period. In limiting the luminance of the backlight BL, the backlight BL is driven intermittently during the illumination period. According to this driving method, the illumination period can be kept unchanged to limit the luminance of the backlight BL, thus preventing the contrast ratio from dropping.

The present invention is not limited to the embodiment described above and may be practiced or embodied in still other ways without departing from the scope and spirit thereof.

Figure 10:
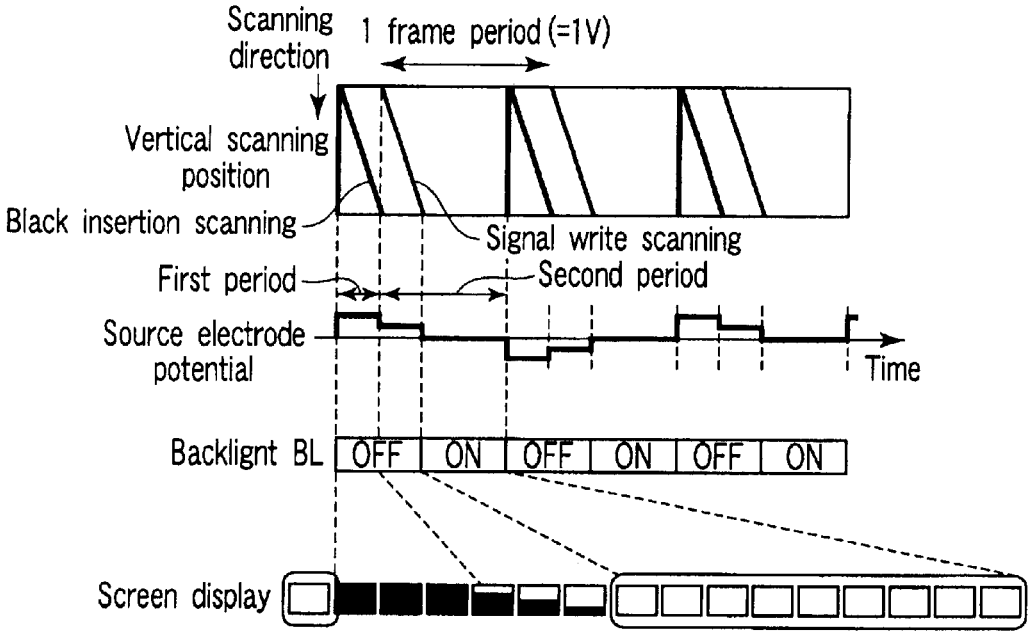
FIG. 10 is a diagram for use in explanation of black insertion driving which differs from the black insertion driving shown in FIG. 2.
Figure 11:
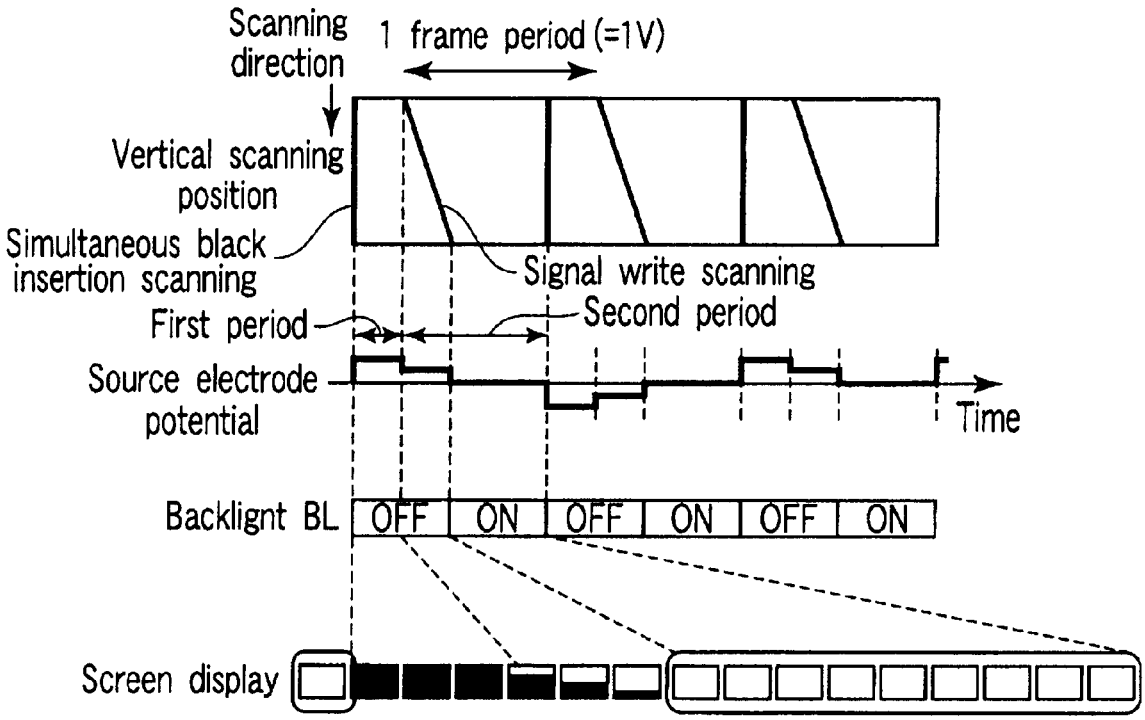
FIG. 11 is a diagram for use in explanation of other black insertion driving which differs from the black insertion driving shown in FIG. 2.

For example, the present invention may be applied to such black insertion driving as shown in FIG. 10 or 11. With this black insertion driving, the backlight BL comprises either a single backlight source or a plurality of backlight sources. The PWM controller 14 is adapted to generate a pulse width modulation signal PWM to the single backlight source or the plurality of backlight sources. The backlight source may be comprised of not only a cold-cathode fluorescent tube but also a light emitting diode (LED) or other light sources.

With the black insertion driving shown in FIG. 10, the gate driver YD and the source driver XD are controlled so as to sequentially perform black insertion writing (application of pixel voltage for black insertion) into all the liquid crystal pixels PX utilizing a first period and then sequentially perform video signal writing (application of pixel voltage for gradation display) into all the pixels PX employing a second period following the first period. In this case, the illumination period using the light from the backlight LB is set to the time interval from completion of video signal writing to initiation of black insertion writing. In order to limit the luminance of the backlight BL, the PWM controller 14 inserts a group of pulses that periodically interrupt the pulse duration in pulse width modulation signals PWM. The pulse width of each of these pulses is determined to meet the dimmer signal DIM as in the case of the embodiment described above.

With the black insertion driving shown in FIG. 11, the gate driver YD and the source driver XD are controlled so as to perform black insertion writing (application of pixel voltage for black insertion) into all the liquid crystal pixels PX at a time utilizing a first period and then sequentially perform video signal writing (application of pixel voltage for gradation display) into all the pixels PX employing a second period following the first period. In this case as well, the illumination period using light from the backlight LB is set to the time interval from completion of video signal writing to initiation of black insertion writing. In order to limit the luminance of the backlight BL, the PWM controller 14 inserts a group of pulses that periodically interrupt the pulse duration in pulse width modulation signals PWM. The pulse width of each of these pulses is determined to meet the dimmer signal DIM as in the case of the embodiment described above.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A liquid crystal display device comprising;

a display panel which periodically performs graduation display and non-graduation display;

a light source unit which illuminates the display panel; and a light source control circuit which controls the light source unit, the light source control circuit including a pulse width modulation controller which generates a pulse width modulation signal having a duty ratio set as the ratio of the illumination period to the period of the gradation display and the non-gradation display, and a drive unit which drives the light source unit during the pulse duration of the pulse width modulation signal supplied from the pulse width modulation controller, wherein the pulse width modulation controller is configured to interrupt the pulse duration in the pulse width modulation signal in order to limit the luminance of the light source unit.

2. The liquid crystal display device according to claim 1, wherein the pulse width modulation controller is configured to insert a group of pulses that periodically interrupt the pulse duration in the pulse width modulation signal in order to limit the luminance of the light source unit.

3. The liquid crystal display device according to claim 2, wherein the pulse width of the group of pulses is determined in accordance with an externally applied dimmer signal.

4. A light source device comprising;

a light source unit which illuminates a display panel adapted to periodically perform gradation display and non-gradation display; and a light source control circuit which controls the light source unit, the light source control circuit including a pulse width modulation controller which generates a pulse width modulation signal having a duty ratio set as the ratio of the illumination period to the period of the gradation display and the non-gradation display, and a drive unit which drives the light source unit during the pulse duration of the pulse width modulation signal supplied from the pulse width modulation controller, wherein the pulse width modulation controller is configured to interrupt the pulse duration in the pulse width modulation signal in order to limit the luminance of the light source unit.

5. The light source device according to claim 4, wherein the pulse width modulation controller is configured to insert a group of pulses that periodically interrupt the pulse duration in the pulse width modulation signal in order to limit the luminance of the light source unit.

6. The light source control device according to claim 5, wherein the pulse width of the group of pulses is determined in accordance with an externally applied dimmer signal.

7. A light source control method for a light source which illuminates a display panel that periodically perform gradation display and non-gradation display, comprising the steps of:

setting an illumination period that allows illumination of the light source unit for the gradation display;

driving the light source unit during the illumination period; generating a pulse width modulation signal having a duty ratio set as the ratio of the illumination period to the period of the gradation display and the non-gradation display, and driving the light source unit during the pulse duration of the pulse width modulation signal; and interrupting the pulse duration in the pulse width modulation signal in order to limit the luminance of the light source unit.

8. The light source control method according to claim 7, further comprising the steps of inserting a group of pulses that periodically interrupt the pulse duration in the pulse width modulation signal in order to limit the luminance of the light source unit.

9. The light source control method according to claim 8, wherein the pulse width of the group of pulses is determined in accordance with an externally applied dimmer signal.

* * * * *